United States Patent [19]

Goutzoulis

[11] Patent Number: 4,686,646

[45] Date of Patent: Aug. 11, 1987

[54] BINARY SPACE-INTEGRATING ACOUSTO-OPTIC PROCESSOR FOR VECTOR-MATRIX MULTIPLICATION

[75] Inventor: Anastasios P. Goutzoulis, Forest Hills Boro, Pa.

[73] Assignee: Westinghouse Electric Corp., Pittsburgh, Pa.

[21] Appl. No.: 729,386

[22] Filed: May 1, 1985

[51] Int. Cl.[4] ..... G06G 9/00; G06G 7/16

[52] U.S. Cl. ..... 364/845; 364/841; 364/713

[58] Field of Search ..... 364/807, 819, 821–822, 364/837, 841, 845, 713, 604, 606, 728, 754; 350/96.1, 96.11–96.17, 162.11, 162.12, 355–356, 358, 320–321

[56] References Cited

U.S. PATENT DOCUMENTS

| | | | |
|---|---|---|---|
| 3,634,749 | 1/1972 | Montgomery | 364/822 X |
| 4,009,380 | 2/1977 | Bocker et al. | 364/713 X |
| 4,037,093 | 7/1977 | Gregg et al. | 364/754 X |
| 4,225,938 | 9/1980 | Turpin | 364/822 |
| 4,329,059 | 5/1982 | Pond et al. | 350/162.12 X |
| 4,389,093 | 6/1983 | Jackson | 350/162.14 |
| 4,468,084 | 8/1984 | Hutcheson et al. | 350/96.11 |
| 4,566,077 | 1/1986 | Schuöcker et al. | 364/845 |
| 4,567,569 | 1/1986 | Caulfield et al. | 364/845 |
| 4,569,033 | 2/1986 | Collins et al. | 364/845 |
| 4,588,255 | 5/1986 | Tur et al. | 350/96.16 |
| 4,595,994 | 6/1986 | Verber et al. | 364/841 |
| 4,603,398 | 7/1986 | Bocker et al. | 364/845 |

OTHER PUBLICATIONS

Sprague, "Time Integrating Acousto-Optic Correlator", *Applied Optics,* Jan. 1976, vol. 15, No. 1, pp. 89–92.

Athale, "Optical Matrix-Matrix Multiplier Based on Outer Product Decomposition", *Applied Optics,* Jun. 1982, vol. 21, No. 12, pp. 2089–2090.

Berg, "Surface-Wave Acousto-Optic Signal Processors", *Optical Engineering,* May/Jun. 1980, vol. 19, No. 3, pp. 359–369.

"Optical Computing", *Computers and Electronics,* Jan. 1985, pp. 64–67 and 82.

Rhodes, "Acousto-Optic Signal Processing: Convolution and Correlation", Proc. of IEEE, vol. 69, No. 1, Jun. 1981, pp. 65–79.

*Primary Examiner*—Gary V. Harkcom

*Attorney, Agent, or Firm*—Thomas R. Trempus

[57] ABSTRACT

An optical processor suitable for matrix-vector multiplication. Coherent light passes through an acousto-optic cell modulated by the elements in the rows of the matrix. This light progresses through a lens system to a magneto-optic cell which is modulated by the column elements of the vector. The light passing through the magneto-optic cell is converged by a spherical lens onto a single optical-to-electrical converter, whose output is applied to an analog-to-digital converter. After conversion to digital values, the result is converted from mixed binary to pure binary form.

7 Claims, 3 Drawing Figures

BINARY SPACE-INTEGRATING ACOUSTO-OPTIC PROCESSOR FOR VECTOR-MATRIX MULTIPLICATION

BACKGROUND OF THE INVENTION

This invention relates, in general, to optical signal processors and, more specifically, to acousto-optic processors for space-integrating vector-matrix multiplication by inner product techniques.

Processing of data containing a large number of separate values is required in several applications, such as in synthetic aperture radar systems and in spectrum analyzers. The quantity of data to be mathematically manipulated often represents a difficult task for even high-speed conventional digital processing techniques, including general and special purpose digital computers.

In many cases, the data is available in matrix and/or vector form, and typically these data expressions must be multiplied together to obtain a resulting matrix or vector of values. In order to accomplish these tasks as quickly as possible, optical processing techniques have been developed. While many optical systems yield high-speed number processing, they are analog devices and fail to give the accuracy desired and obtainable by slower non-optical digital processors.

To overcome these problems, efforts have been made to provide processing techniques which give the speed of optical systems along with the accuracy and precision of digital systems. Accuracy better than the 7 to 9 bit accuracy of conventional optical analog systems is desirable. Such improvement is claimed by processes which implement digital multiplication using analog convolution and which uses two's complement arithmetic. An implementation of the former has been suggested in connection with an acousto-optic systolic system for rapid and accurate vector-matrix multiplication wherein optics is used for the parallel formation of the M element products and wherein M detectors are required for their detection, where M is the dimension of the input vector.

General background on optical processing is described in the article, "Optical Computing," contained in *Computers and Electronics,* January, 1985, pp. 64–67 and 82. A more technical description of optical processing is contained in "Bragg Signal Processing and Output Devices," published by the International Society for Optical Engineering, in 1982.

A prior art system described by William T. Rhodes in "Acousto-Optic Signal Processing: Convolution and Correlation," Proceedings of the IEEE, Volume 69, No. 1, June, 1981, uses spatial light modulators for signal processing. In the single cell systems desribed therein, reference masks, which may be phototransparencies, are used as a means for changing the light passing through the acousto-optic cell. The two-cell systems described by Rhodes are significantly different from the teachings of the present invention.

U.S. Pat. No. 4,389,093, issued on June 21, 1983, teaches a method and apparatus for coherent detection in optical processors. While this patent teaches the use of a spatial light modulator followed by a spherical lens and a photodetector, it does not use a second spatial light modulator as does the present invention, but uses an optical mask. Other significant features distinguish the present invention from the device taught in the referenced patent.

It is desirable, and it is an object of this invention, to provide an optical processor having fast computational speed, high bit accuracy, and a simple hardware configuration.

SUMMARY OF THE INVENTION

There is disclosed herein a new and useful arrangement for optically multiplying vector-matrix expressiions. The arrangement includes a source of coherent light applied to an acousto-optic cell, a lens focusing system between the acousto-optic cell and a magneto-optic cell, and a spherical lens which converges light passing through the magneto-optic cell onto a single optical-to-electrical detector. The electrical signals provided by the detector are applied to an analog-to-digital converter.

In multiplying a matrix by a vector, the device of this invention first applies digital values to the two spatial light modulator cells corresponding to the values of the elements in the matrix and in the vector. Values of the vector column are entered into the magneto-optic cell and values of the first row in the matrix are entered into the acousto-optic cell. The detector output is sampled to give the value for one element of the result. Then, the next row of the matrix is entered into the acousto-optic cell and the detector gives the value for the next element of the result. This process is repeated until every row of the matrix has been entered into the acousto-optic cell. Since matrix-matrix multiplication requires matrix-vector results, the disclosed invention may be used repeatedly to form the product of two matrices.

BRIEF DESCRIPTION OF THE DRAWINGS

Further advantages and uses of this invention will become more apparent when considered in view of the following detailed description and drawing, in which.

DESCRIPTION OF THE PREFERRED EMBODIMENTS

Figure 1:
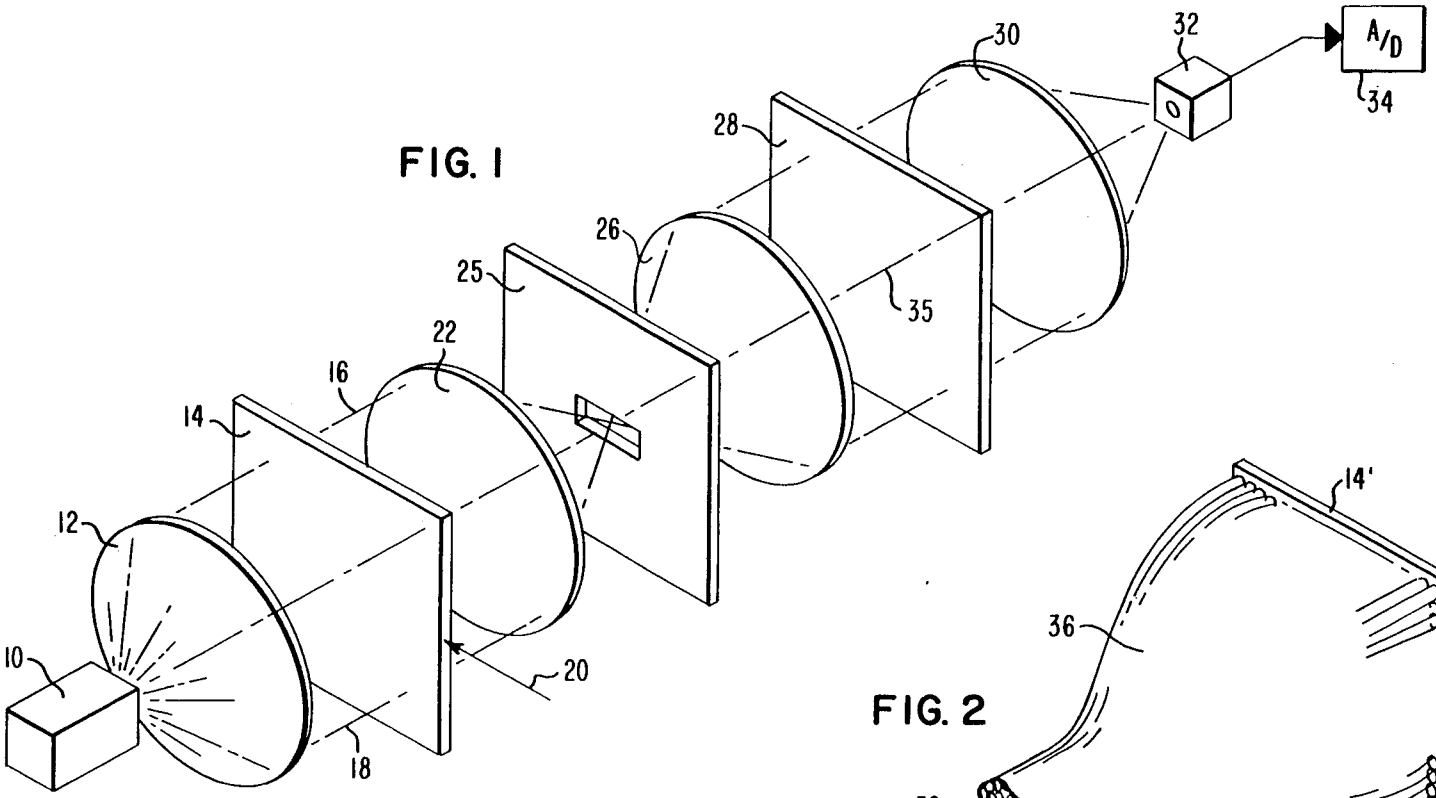
FIG. 1 is a perspective view showing the arrangement of components in a processor constructed according to one embodiment of the invention.

Throughout the following description, similar reference characters refer to similar elements or members in all of the figures of the drawing.

Referring now to the drawing, and to FIG. 1 in particular, there is shown an arrangement of components which may be used for vector-matrix multiplication according to this invention. A source of coherent light, such as the laser 10, produces light which is collimated by the lens 12 and directed onto the acousto-optic cell 14. The laser includes a diverging lens to spread the light over the lens 12. Dashed lines 16 and 18 represent individual light rays and indicate the general path of the light through the elements or components shown in FIG. 1.

The acousto-optic (AO) cell 14 is a conventional two-dimensional spatial light modulator (SLM), available from various manufacturers. The AO cell 14 functions to modulate the light applied to the cell so that the light passing through the cell is varied according to the applied acoustic modulation signal 20. Since the modulation signal propagates through the AO cell 14 in a finite period of time, the amount of light passed by the AO cell 14 may be different for light rays located at different positions on the surface of the cell. A more detailed description of the operation of the components shown in FIG. 1 is given in connection with the description of FIG. 3, included later herein.

Light passing through the AO cell 14 is refracted by the lens 22 and passes through the slit or opening 24 in the plate or filter 25. The filter 25 helps to block the unwanted light rays coming from the AO cell 14 which have not been modulated properly as a result of the changes in the index of refraction of the cell material during modulation. After passing through the filter 25, the properly modulated light is focused by the lens 26 onto the magneto-optic (MO) cell 28, which is another form of a spatial light modulator (SLM). It is emphasized that the invention disclosed herein may function properly with the SLM's 14 and 28 being either acousto-optic or magneto-optic cells, a combination of the two types, or any other similar device which spatially modulates light signals. Aside from propagation speed differences between the two types of cells, the major difference between them is the fact that MO cells do not require refreshing of the applied modulation signal as do AO cells.

Although not shown in FIG. 1, other components may be required for the proper operation of the magneto-optic cell 28. More specifically, a polarizer may be inserted between the cell 14 and the cell 28, and an analyzer may be positioned between the cell 28 and the lens 30.

The modulated light passing through the MO cell 28 is converged by the lens 30 onto the detector 32 which has its electrical output signal applied to the analog-to-digital (A/D) converter 34. The detector 32 may be any device of suitable response for converting optical signals into electrical signals. The detector 32 is located at the centroid axis 35 of the system components, or that axis which extends through the centers of the optical lenses. The A/D converter 34 furnishes the means by which the resulting output is converted into the desired digital electrical form.

Figure 2:
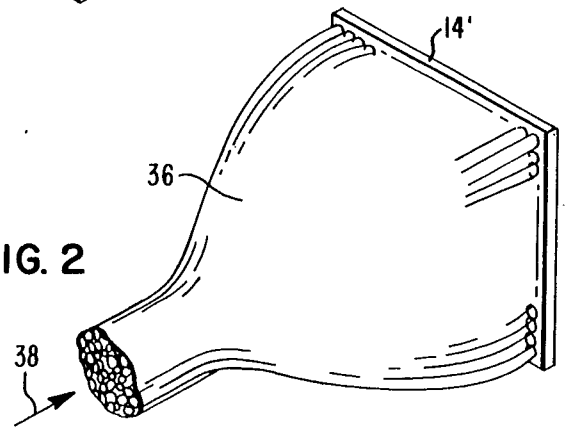
FIG. 2 is a partial view showing how the processor shown in FIG. 1 can be modified according to another embodiment of the invention.

FIG. 2 illustrates another embodiment of the invention which uses an array of optical fibers 36 to provide properly phased light upon the AO cell 14'. The optical fibers 36 are illuminated by a suitable light source as indicated by the arrow 38. When using this method, the optical fibers 36 take the place of the lens 12 shown in FIG. 1.

The components in FIG. 1 function as a vector-matrix multiplier based upon the algorithm of digital multiplication by means of analog convolution. Only a single detector is needed for inner product detection. Multiplication of two binary numbers by means of analog convolution is based upon convolving the binary words representing the two numbers. The result is generated in a mixed binary format where, like binary arithmetic, each digit is weighted by a power of two, but unlike binary arithmetic, each digit can be greater than one. As an example, consider the calculation of the products 15·41 and 29·62. First, the binary representations of the numbers are convolved for each product. The results of the convolutions are:

$$(15\cdot41):\ [001111]*[101001]=[00112212111] \tag{1}$$

$$(29\cdot62):\ [011101]*[111110]=[01233432110] \tag{2}$$

Next, each convolution point is weighted by a power of two. Finally, the weighted points are summed to obtain the final result:

$$15\cdot41=[1\cdot2^8+1\cdot2^7+2\cdot2^6+\ldots+1\cdot2^0]=615 \tag{3}$$

$$29\cdot62=[1\cdot2^9+2\cdot2^8+3\cdot2^7+\ldots+0\cdot2^0]=1798 \tag{4}$$

Note that in order to sum different products, which is the case for inner products, the corresponding convolution points are summed and consequently weight and sum equation (3). For example:

$$(15\cdot41)+(29\cdot62)=[(1+0)\cdot2^9+(2+1)\cdot2^8+(3+1)\cdot2^7+\ldots+(1+0)\cdot2^0]=2413 \tag{5}$$

The importance of this arrangement comes because of the dynamic range requirements. For example, to multiply two numbers each with a dynamic range of $N=2^{16}=65{,}536$, an output dynamic range of $N=2^{32}\simeq4.3\times10^9$ is needed. With binary encoding, the input and output dynamic range must be two (for example, 0 and 1) and 16 (for example, when all 16 bits are 1), respectively. Consider now the summation of 50 such products. If analog techniques were used, an output dynamic range of $2.1\times10^{11}$ would be needed. With the binary arrangement, input and output dynamic ranges of 2 and $50\cdot16=800$ would be needed.

Notice that once the convolution data has been generated, in analog form, an A/D converter in conjunction with a shift-register/adder can be used to convert the mixed binary data to regular binary data. The A/D converter requirement is for $\log_2 k$ bits, where k is the maximum value of the mixed binary data.

The above-described binary space-integrating technique or algorithm is used by the present invention for multiplication of matrices, such as matrices A and B, each of rank M. Such operation may be represented:

$$A\cdot B=\begin{bmatrix} a_{11} & \ldots & a_{1M} \\ \cdot & & \cdot \\ \cdot & & \cdot \\ \cdot & & \cdot \\ a_{M1} & \ldots & a_{MM} \end{bmatrix}\begin{bmatrix} b_{11} & \ldots & b_{1M} \\ \cdot & & \cdot \\ \cdot & & \cdot \\ \cdot & & \cdot \\ b_{M1} & \ldots & b_{MM} \end{bmatrix}= \tag{6}$$

$$C=\begin{bmatrix} c_{11} & \ldots & c_{1M} \\ \cdot & & \cdot \\ \cdot & & \cdot \\ \cdot & & \cdot \\ c_{M1} & \ldots & c_{MM} \end{bmatrix}=$$

$$\begin{bmatrix} a_{11}b_{11}+\ldots+a_{1M}b_{M1} & \ldots & a_{11}b_{1M}+\ldots+a_{1M}b_{MM} \\ \cdot & \ldots & \cdot \\ \cdot & \ldots & \cdot \\ \cdot & \ldots & \cdot \\ a_{M1}b_{11}+\ldots+a_{MM}b_{M1} & \ldots & a_{M1}b_{1M}+\ldots+a_{MM}b_{MM} \end{bmatrix}$$

Each of the $C_{ij}$ elements is an inner product between the ith row of matrix A and the jth column of matrix B. By observing equation (6), it can be seen that each inner product is the summation of M element products. To obtain a complete column of the C matrix, it is necessary to calculate a vector-matrix product which corresponds to the calculation of M inner products. Consequently, a full matrix-matrix multiplication is the formation of M vector-matrix multiplications. The system addressed here calculates inner products and thus can be used for either vector-matrix or matrix-matrix multiplication. To simplify the description, however, a vector-matrix multiplication embodiment is described.

Figure 3:
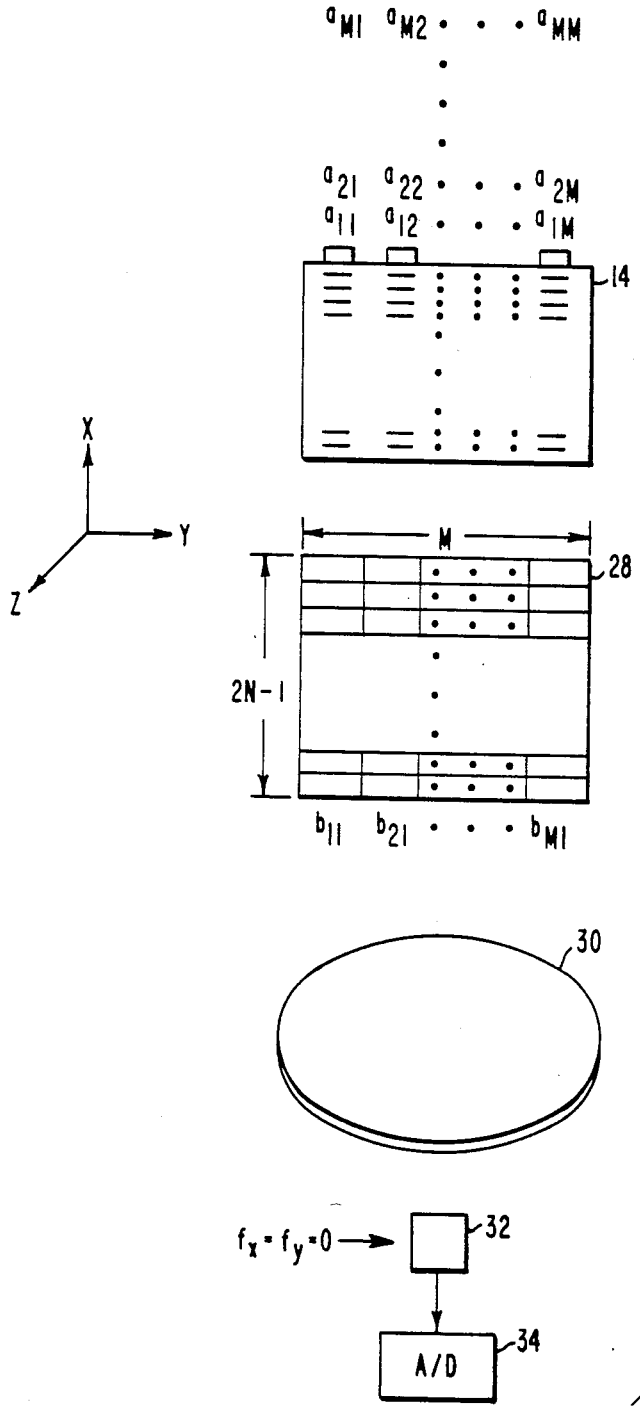
FIG. 3 is a schematic representation of the processor shown in FIG. 1.

Referring to the optical system of FIG. 3, the acousto-optic cell 14 is an M-channel cell, where M is the dimension of the input vector. The AO cell 14 is arranged such that the sound propagates along the x-dimension. Collimated light illuminates AO cell 14. The first-order diffracted beams are imaged, through an optical subsystem not shown in FIG. 3, onto a 2-D spatial light modulator 28 composed of $(2N-1)\times M$ pixels where N is the number of bits needed to represent, in binary form, the values of the input vectors. Spherical lens 30 forms the 2-D Fourier transform of the resulting image. A single element detector 32 is placed at the back focal plane of the lens 30 and at location $fx=fy=0$. The output of the detector 32 is amplified and subsequently drives the A/D converter 34.

To form the product of the matrix A and the vector b, which is the first column of matrix B in equation (6), we assume that the values of the elements of both A and b are available in binary form. Then, the data of vector b is loaded onto the 2-D SLM 28. The device is loaded such that each column corresponds to a binary word. Thus, M different elements are written along y and along x, and the binary words that correspond to each of the M elements are written. The binary data, along x, is written such that each bit is followed by a space or zero which is necessary in order to separate different convolution points. The M values of the first row of matrix A are loaded, in parallel, onto AO cell 14. The loading takes place in a bit-serial mode where each bit is followed by a zero and such that the least significant bits (LSB) are applied first, under the assumption that the most significant bits (MSB) of the $b_{i1}$ data were written onto the top row of the SLM 28. The MSB would be applied first if the LSB were written onto the top row of cell 28.

Since the "spatially moving" data $a_{1j}$is imaged onto the stationary $b_{i1}$data, lens 30, because of is integration property along x, forms, in parallel M convolutions, $a_{1j}*b_{i1}$, $i=j=1,2 \ldots M$. These M convolutions are the analog convolutions of the binary words that represent the $a_{1j}$and $b_{i1}$data. Since lens 30 is spherical, its integration power along y is used to sum the M convolutions. The summation is such that the same convolution points of the $Ma_{1j}*b_{i1}$convolutions are added in parallel as seen in equation (5). Thus, the single element detector, located at $fx=fy=0$, will yield a time-varying output which corresponds to a convolution that represents, in mixed binary form, the inner product of the vector b with the first row of the matrix A. The analog convolution is then read out in binary form by means for the A/D converter. Consequently, a shift-register/adder is used to form weighting/summation which corresponds to the conversion from mixed binary form to a pure binary form. Repeating the process $M-1$ times, wherein each time a different row of A is loaded onto AO cell 14, the final result is obtained, which is the M inner products that correspond to A·b.

The binary algorithm used allows the processor to have input and output dynamic ranges of N and 2N, respectively. The component dynamic range requirements are 2:1 for the AO cell/MO cell and $N\times M$:1 for the detector. The maximum value of the output convolution is NxM. Thus, for a 32 element vector-vector multiplication application with 8 bits input accuracy, the detector dynamic range needs to be at least 256:1. However, use of a detector with higher dynamic range is preferable in order to minimize the probability of detection errors. Since $N\times M$ is the maximum convolution value, an A/D converter of $\log_2(N\times M)$ bits is required. Thus, for the above example, an A/D of at least 8 bits is needed.

To avoid computational errors, both the AO cell and the MO cell should be very uniform over their entire apertures. This is required because of the 2-D spatial integration used. If non-uniform devices are used, convolution points of the same analog value will correspond to different light levels. Consequently, spatial integration will yield an incorrect output. The resulting error could be large if one considers the fact that each convolution point is to be weighted by a power of 2. Analysis has shown that the uniformity required should be better than $N\times M$:1 and tends to approach the detector's dynamic range of $>N\times M$:1. Good AO cell uniformity is achievable because the required AO time-aperture is small, such as 0.64 microseconds for $N=32$ and a bit-width of 20 nanoseconds. Small aperture associated with low acoustic attenuation AO crystals will result in a very uniform acoustic field which corresponds to the propagating bit-stream. On the other hand, because of the small aperture, acoustic diffraction is controllable.

The processing speed of this invention is limited by the read out speed which, in turn, is limited by the speed of the A/D converter. For a 32 element vector-vector problem with 8 bits input accuracy, the maximum value of the output convolution is $8\times 32=256$. To read out this value, the A/D converter must have at least 8 bits. Thus, both the throughput rate and power efficiency are limited by the output A/D converter.

It is emphasized that numerous changes may be made in the above-described system. Since different embodiments of the invention may be made without departing from the spirit thereof, it is intended that all of the matter contained in the foregoing description, or shown in the accompanying drawing, shall be interpreted as illustrative rather than limiting.

I claim as my invention:

1. An optical processor for matrix-vector multiplication, said processor comprising:

a first spatial light modulator;

a second spatial light modulator;

means for applying coherent light to said first spatial light modulator;

means for modulating said first spatial light modulator in parallel with element values from a row in the matrix;

means for focusing the coherent light which passes through said first spatial light modulator onto said second spatial light modulator, said focusing means including second and third spherical lens and an opaque member having an opening therein, said opaque member being located between said second and third spherical lens, said second lens being located adjacent to the first spatial light modulator, and said third lens being located adjacent to the second spatial light modulator;

means for modulating said second spatial light modulator in parallel with element values from a column in said vector;

a single detector located along an axis defined by said lens, said axis passing through the center of said first spherical lens and through the focal point of said lens, and functional to convert converged light from said lens into electrical signals; and an analog-to-digital converter to which the electrical signals from said detector are applied, said analog-to-digital converter functional to convert the electrical signals from said detector to binary form.

2. The optical processor of claim 1 wherein the first spatial light modulator is an acousto-optic cell.

3. The optical processor of claim 1 wherein the second spatial light modulator is a magneto-optic cell.

4. The optical processor of claim 1 wherein the means for applying coherent light to the first spatial light modulator includes a laser and a collimating lens.

5. The optical processor of claim 1 wherein the means for applying coherent light to the first spatial light modulator includes a light source and a plurality of optic fibers having their ends positioned near a surface of the first spatial light modulator.

6. The optical processor of claim 1 wherein data loaded into the second spatial light modulator is written such that each bit is followed by a zero or space which separates different convolution points.

7. A method for optically multiplying a multi-element matrix by a multi-element vector quantity, said method comprising the steps of:

modulating a first spatial light modulator with element values simultaneously from a row in the matrix;

directing modulated light from said first spatial light modulator to a second spatial light modulator;

modulating said second spatial light modulator with a modulating signal which is reflective of element values from a column in the vector and which further includes a serial bit-stream corresponding to the binary equivalent of the element value, with a single fixed binary value inserted between each of the binary bits;

two-dimensionally converging the light from the second spatial light modulator;

converting the total converged light into an equivalent electrical signal; and changing the electrical signal into digital form.

* * * * *